US008419098B1

(12) United States Patent
Smith

(10) Patent No.: US 8,419,098 B1
(45) Date of Patent: Apr. 16, 2013

(54) POOL CHLORINE TABLET HOLDER

(76) Inventor: Nicholas Michael Smith, Austin, TX (US)

( * ) Notice: Subject to any disclaimer, the term of this patent is extended or adjusted under 35 U.S.C. 154(b) by 4 days.

(21) Appl. No.: 13/342,029

(22) Filed: Dec. 31, 2011

(51) Int. Cl.
*B66F 19/00* (2006.01)

(52) U.S. Cl.
USPC ..... 294/209

(58) Field of Classification Search ..... 294/209, 294/211, 3, 219, 22, 34, 119.1
See application file for complete search history.

(56) References Cited

U.S. PATENT DOCUMENTS

| | | | | | |
|---|---|---|---|---|---|
| 277,531 | A * | 5/1883 | Achermann | 7/109 |
| 420,725 | A * | 2/1890 | Jeffrey | 294/22 |
| 747,376 | A * | 12/1903 | Christman | 294/22 |
| 2,613,100 | A * | 10/1952 | Casey, Jr. | 294/115 |
| 3,261,479 | A * | 7/1966 | Baker et al. | 414/787 |
| 4,330,936 | A * | 5/1982 | Swarth | 30/124 |
| 4,900,078 | A * | 2/1990 | Bloch | 294/86.4 |
| 5,186,515 | A * | 2/1993 | Goldberg et al. | 294/119.1 |
| 5,441,322 | A * | 8/1995 | Jobmann et al. | 294/90 |
| 5,941,586 | A * | 8/1999 | Fann | 294/104 |
| 2006/0125260 | A1 * | 6/2006 | Chae et al. | 294/119.1 |

OTHER PUBLICATIONS

Cheap Swimming Pool Products, "Plastic Quick Snap Vac Handle", http://www.cheappoolproducts.com/Plastic~Quick~Snap~Vac~Handle_64_1760~product.html, retrieved from the Internet on Nov. 24, 2011. Cheap Swimming Pool Products, "V Shaped Spring Clip", http://www.cheappoolproducts.com/V~Shaped~Spring~Clip_64_1757~product.html, retrieved from the Internet on Nov. 24, 2011.

Cheap Swimming Pool Products, "V Shaped Spring Clip", http://www.cheappoolproducts.com/V~Shaped~Spring~Clip_64_1757~product.html, retrieved from the Internet on Nov. 24, 2011.

Pentair Water Pool and SPA, Inc., "2012 Product Catalog", https://www.pentairpartners.com/productcatalog/pdf/PentairPoolProductsCatalog2012_US.pdf, p. 140, retrieved on Nov. 24, 2011.

* cited by examiner

*Primary Examiner* — Saul Rodriguez
*Assistant Examiner* — Gabriela Puig

(57) ABSTRACT

Systems, methods and apparatus are provided through which in some implementations a pool chlorine tablet holder includes moveable arms that are adjustable at both ends for symmetrically holding a chlorine tablet.

3 Claims, 6 Drawing Sheets

POOL CHLORINE TABLET HOLDER

FIELD

This disclosure relates generally to pool accessories, and more particularly to pool chlorine tablet holders.

BACKGROUND

A conventional pool chlorine tablet holder includes a handle with a bifurcated rotating member. The rotating member is rotably attached to the handle. The only rotation point on the pool chlorine tablet holder is the between the rotating member and the handle. The bifurcated rotating member includes two fixed arms that are operable to grip a chlorine tablet holder. The fixed arms are fixed to the rotating member, and in some implementations, the fixed arms are a singular piece with the rotating member. The width of the arms are fixed at the end of the arms near the rotation point, and the width of the arms are adjustable at the end of arms opposite from the rotation point.

BRIEF DESCRIPTION

The above-mentioned shortcomings, disadvantages and problems are addressed herein, which will be understood by reading and studying the following specification.

In an aspect, a pool chlorine tablet holder including two moveable arms having two ends, the two moveable arms being mechanically coupled to each other, and being adjustable at both ends for symmetrically holding a chlorine tablet between the two arms.

In one aspect, an apparatus includes a handle comprising a substantially round elongated portion, the substantially round elongated portion being hollow with an open end, the handle further comprising a bifurcated portion, the bifurcated portion having a first fork having an inside portion and an outside portion, the bifurcated portion having a second fork, the second fork having an inside portion and an outside portion, the inside portion of the first fork being directly opposing and opposite to the inside portion of the second fork, the hollow round elongated portion having a first hole that extends through the hollow round elongated portion and a second hole that extends through the hollow round elongated portion directly opposite of the first hole wherein an axis extending between the first hole and the second hole are perpendicular to an axis of the handle, the hollow round elongated portion having a spring clip therein, the spring clip being adapted to connect the handle to a pool extension pole in which the spring clip includes a bifurcated elastic element having a first flat curved element that converges at one end of the two bifurcated elastic elements and a second flat curved element that converges with the first flat curved element, the first flat curved element having a round member that is substantially perpendicular to the bifurcated plastic element and extending through the first hole of the hollow round elongated portion of the handle and the second flat curved element having a round member that is substantially perpendicular to the bifurcated plastic element and extending through the second hole of the hollow round elongated portion of the handle, a rotating member having a first end and a second end, the first end being rotatable mounted to the inside portion of the first fork of the bifurcated portion of the handle and the second end being rotatably mounted to the inside portion of the second fork of the bifurcated portion of the handle, wherein an exterior of the rotating member is substantially equidistant to a longitudinal axis of the rotating member, wherein the rotating member includes a cavity that is substantially equidistant to the longitudinal axis of the rotating member, the cavity extending from the first end of the rotating member to the second end of the rotating member and forming an opening that extends from the first end of the rotating member to the second end of the rotating member, the rotating member having a first flange and a second flange, the first flange being connected by a bridge, the bridge having a first end and a second end, the bridge having a cavity, the cavity having a longitudinal axis, the cavity extending from the first end of the bridge to the second end of the bridge and through each of the first flange and the second flange, the first flange and the second flange each having flat exterior surfaces, a first moveable arm having a flat surface facing the flat exterior surface of the first flange, having a first hole that passes through the first moveable arm, the first hole being positioned closer to a first end of the first moveable arm than a second end of the first moveable arm, the first hole having the same longitudinal axis as the longitudinal axis as the cavity of the bridge of the rotating member, the first moveable arm having a second hole positioned closer to the second end of the first moveable arm than the first end of the first moveable arm, the first end of the first moveable arm adjacent to the end of the first fork, a second moveable arm having a flat surface facing the flat exterior surface of the second flange, having a first hole that passes through the second moveable arm, the first hole being positioned closer to a first end of the second moveable arm than a second end of the second moveable arm, the first hole having the same longitudinal axis as the longitudinal axis as the cavity of the bridge of the rotating member, the second moveable arm having a second hole positioned closer to the second end of the second moveable arm than the first end of the second moveable arm, the first end of the second moveable arm adjacent to the end of the second fork, a first bolt passing slideably through the first hole of the first moveable arm, the cavity of the rotating member and the first hole of the second moveable arm, the first bolt having a retaining member at each end of the first bolt operable to urge the first moveable arm and the second moveable arms towards each other and a second bolt passing slideably through the second hole of the first moveable arm, the cavity of the bridge and the second hole of the second moveable arm, the second bolt having a retaining member at each end of the second bolt operable to urge the first moveable arm and the second moveable arms towards each other.

In another aspect, an apparatus includes a handle comprising a substantially round elongated portion, the substantially round elongated portion being hollow with an open end, the handle further comprising a bifurcated portion, the bifurcated portion having a first fork having an inside portion and an outside portion, the bifurcated portion having a second fork, the second fork having an inside portion and an outside portion, the inside portion of the first fork being directly opposing and opposite to the inside portion of the second fork, the hollow round elongated portion having a first hole that extends through the hollow round elongated portion and a second hole that extends through the hollow round elongated portion directly opposite of the first hole wherein an axis extending between the first hole and the second hole are perpendicular to a longitudinal axis of the handle, a rotating member having a first end and a second end, the first end being rotatable mounted to the inside portion of the first fork of the bifurcated portion of the handle and the second end being rotatably mounted to the inside portion of the second fork of the bifurcated portion of the handle, wherein an exterior of the rotating member is substantially equidistant to a longitudinal axis of the rotating member, wherein the rotating member includes a cavity that is substantially equidistant to the longitudinal axis of the rotating member, the cavity extending from the first end of the rotating member to the second end of the rotating member and forming an opening that extends from the first end of the rotating member to the second end of the rotating member, the rotating member having a first flange and a second flange, the first flange being connected by a bridge, the bridge having a first end and a second end, the bridge having a cavity, the cavity having a longitudinal axis, the cavity extending from the first end of the bridge to the second end of the bridge and through each of the first flange and the second flange, the first flange and the second flange each having flat exterior surfaces, a first moveable arm having a flat surface facing the flat exterior surface of the first flange, having a first hole that passes through the first moveable arm, the first hole being positioned closer to a first end of the first moveable arm than a second end of the first moveable arm, the first hole having the same longitudinal axis as the longitudinal axis as the cavity of the bridge of the rotating member, the first moveable arm having a second hole positioned closer to the second end of the first moveable arm than the first end of the first moveable arm, the first end of the first moveable arm adjacent to the end of the first fork, a second moveable arm having a flat surface facing the flat exterior surface of the second flange, having a first hole that passes through the second moveable arm, the first hole being positioned closer to a first end of the second moveable arm than a second end of the second moveable arm, the first hole having the same longitudinal axis as the longitudinal axis as the cavity of the bridge of the rotating member, the second moveable arm having a second hole positioned closer to the second end of the second moveable arm than the first end of the second moveable arm, the first end of the second moveable arm adjacent to the end of the second fork, a first bolt passing slideably through the first hole of the first moveable arm, the cavity of the rotating member and the first hole of the second moveable arm, the first bolt having a retaining member at each end of the first bolt operable to urge the first moveable arm and the second moveable arms towards each other and a second bolt passing slideably through the second hole of the first moveable arm, the cavity of the bridge and the second hole of the second moveable arm, the second bolt having a retaining member at each end of the second bolt operable to urge the first moveable arm and the second moveable arms towards each other.

Apparatus, systems, and methods of varying scope are described herein. In addition to the aspects and advantages described in this summary, further aspects and advantages will become apparent by reference to the drawings and by reading the detailed description that follows.

DETAILED DESCRIPTION

In the following detailed description, reference is made to the accompanying drawings that form a part hereof, and in which is shown by way of illustration specific implementations which may be practiced. These implementations are described in sufficient detail to enable those skilled in the art to practice the implementations, and it is to be understood that other implementations may be utilized and that logical, mechanical, electrical and other changes may be made without departing from the scope of the implementations. The following detailed description is, therefore, not to be taken in a limiting sense.

The detailed description is divided into three sections. In the first section, apparatus of implementations are described. In the second section, implementations of methods are described. Finally, in the third section, a conclusion of the detailed description is provided.

Apparatus Implementations

In this section, the particular apparatus of such an implementation are described by reference to a series of diagrams.

Figure 1:
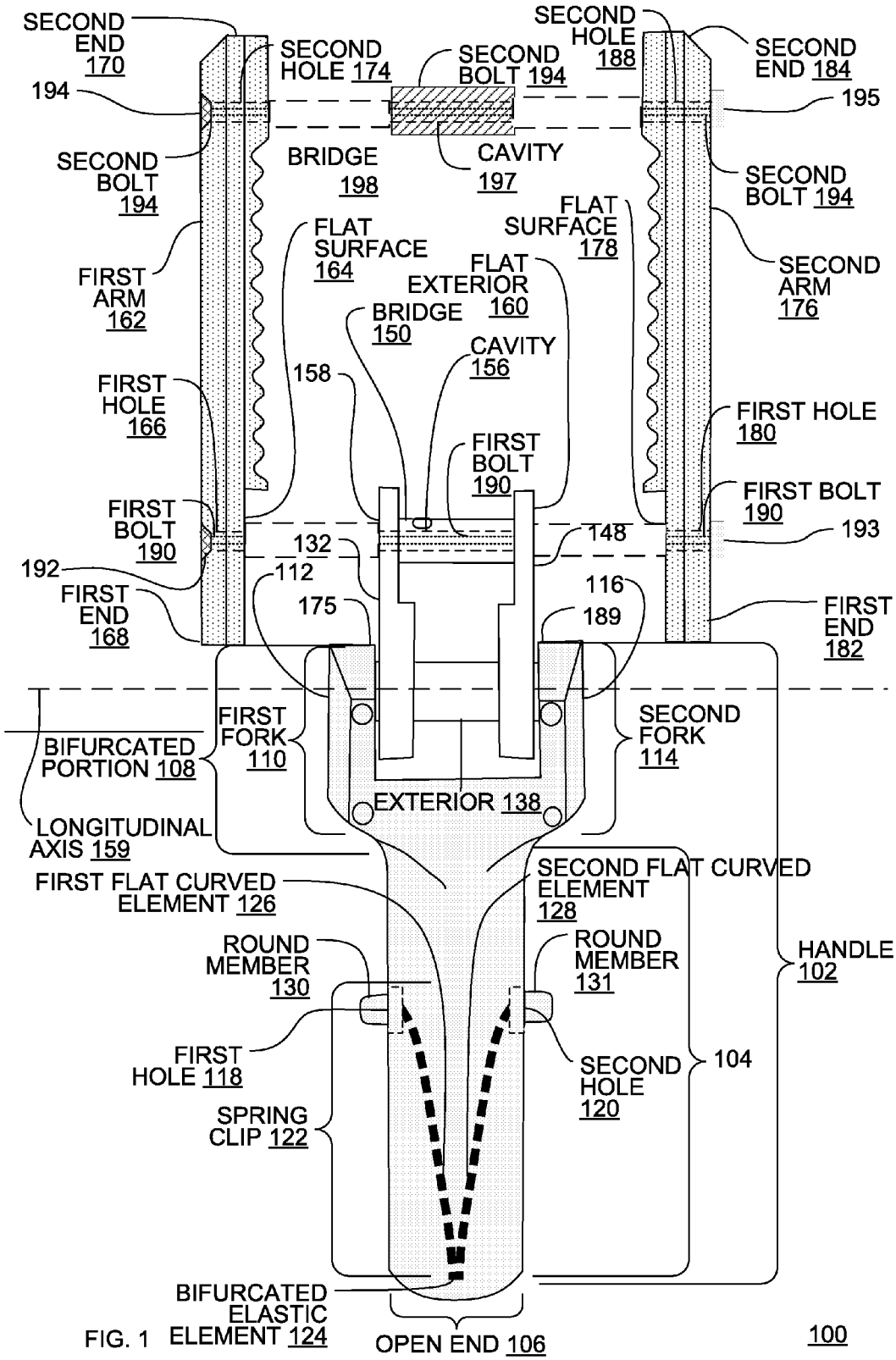
FIG. 1 is an exploded top view of a cross section block diagram of apparatus according to an implementation to hold a chlorine tablet.

FIG. 1 is an exploded top view of a cross section block diagram of apparatus 100 according to an implementation to hold a chlorine tablet. Apparatus 100 provides symmetrical gripping of a pool chlorine tablet.

Apparatus 100 includes a handle 102. The handle 102 includes a substantially round elongated portion 104. The substantially round elongated portion 104 is hollow. The substantially round elongated portion has an open end 106.

The handle 102 includes a bifurcated (forked) portion 108. The bifurcated portion 108 has a first fork 110. The first fork 110 has an outside portion 112. The bifurcated portion 108 also has a second fork 114. The second fork 114 has an outside portion 116. The hollow round elongated portion 104 has a first hole 118 that extends through the hollow round elongated portion 104 and a second hole 120 that extends through the hollow round elongated portion 104 directly opposite of the first hole 118 wherein an axis 119 extending between the first hole 118 and the second hole 120 are perpendicular to an axis 121 of the handle 102.

Some implementations of the hollow round elongated portion 104 include a spring clip 122 therein. The spring clip 122 is adapted to connect the handle 102 to a pool extension pole (not shown). The spring clip 122 includes a bifurcated elastic element 124 which encompasses a first flat curved element 126. The first flat curved element 126 converges at one end of the bifurcated elastic element 124 with a second flat curved element 128. The first flat curved element 126 of specifically attached to a round member 130. The round member 130 moves substantially along axis 119 and perpendicular to the bifurcated plastic element 124 and the axis 121. The round member 130 extends through the first hole 118 of the hollow round elongated portion 104 of the handle 102. The second flat curved element 128 of specifically attached to a round member 131. The round member 131 moves substantially perpendicular to the bifurcated plastic element 124. The round member 131 extends through the second hole 120 of the hollow round elongated portion 104 of the handle 102. When a pool extension pole is slid over the round members 130 and 131, the round members 130 and 131 will compress into the holes 118 and 120 of the handle 102 and when holes in the pool extension pole are positioned over the round members 130 and 131, the round members will be urged by compression force to pop into the holes of the pool extension pole, thereby immoveably engaging the apparatus 100 to the pool extension pole.

A first moveable arm 162 has a flat surface 164 facing a flat exterior surface 158 of the first flange 146. The flat surface 164 has a first hole 166 that passes through the first moveable arm 162. The first hole 166 is positioned closer to a first end 168 of the first moveable arm 162 than a second end 170 of the first moveable arm 162. The first hole 166 has the same longitudinal axis as a longitudinal axis 159 of a cavity 156 of a bridge 150 of a rotating member 132. The first moveable arm 162 has a second hole 174 positioned closer to the second end 170 of the first moveable arm 162 than the first end 168 of the first moveable arm 162. The first end 168 of the first moveable arm 162 is adjacent to a end 175 of a first fork 110.

A second moveable arm 176 has a flat surface 178 facing a flat exterior surface 160 of a second flange 148. The flat surface 178 has a first hole 180 that passes through the second moveable arm 176. The first hole 180 is positioned closer to a first end 182 of the second moveable arm 176 than a second end 184 of the second moveable arm 176. The first hole 180 has the same longitudinal axis as the longitudinal axis 159 as the cavity 156 of the bridge 150 of the rotating member 132. The second moveable arm 176 has a second hole 188 that is positioned closer to the second end 184 of the second moveable arm 176 than the first end 182 of the second moveable arm 176. The first end 182 of the second moveable arm 176 is adjacent to a end 189 of the second fork 114.

A first bolt 190 passes slideably through the first hole 166 of the first moveable arm 162 continuing into the cavity 156 of the rotating member 132 and the first hole 180 of the second moveable arm 176. The first bolt 190 has a retaining member 192 and 193 at each end of the first bolt 190 operable to urge the first moveable arm 162 and the second moveable arm 176 towards each other. The first bolt 190 provides adjustment of the distance between moveable arms 162 and 176 at the first end 168.

A second bolt 194 passes slideably through the second hole 174 of the first moveable arm 162 continuing into a cavity 197 of a bridge 198 and the second hole 188 of the second moveable arm 176. The second bolt 194 has a retaining member 195 and 196 at each end of the second bolt 194 operable to urge the first moveable arm 162 and the second moveable arm 176 towards each other. The second bolt 194 provides adjustment of the distance between moveable arms 162 and 176 at the second end 170. Examples of retaining members 192, 193, 195 and 196 include boltheads and nuts.

The first bolt 190 provides adjustment of the distance between moveable arms 162 and 176 and in cooperation with the second bolt 194 that provides adjustment between moveable arms 162 and 176, adjustment of the distance between the moveable arms 162 and 176 along the entire length of the moveable arms 162 and 176 allows symmetrical holding of a chlorine tablet between the moveable arms 162 and 176. Thus, a chlorine tablet can be placed and held with symmetrical force between the moveable arms 162 and 176 having bolts 190 and 194 and retaining members 192, 193, 195 and 196.

Both of the moveable arms 162 and 176 have irregular surfaces on the opposing surfaces that are suitable for gripping an object, such as a pool chlorine tablet between the moveable arms 162 and 176 when the retaining members 192 and 193 are adjusted on the first bolt 190 to provide pressure by the moveable arms 162 and 176 towards each other and when the retaining members 195 and 196 are adjusted on the second bolt 194 to provide pressure by the moveable arms 162 and 176 towards each other.

While the apparatus 100 is not limited to any particular handle 102, elongated portion 104, open end 106, bifurcated portion 108, first fork 110, inside portion 111, outside portion 112, second fork 114, inside portion 115, outside portion 116, first hole 118, axis 119, second hole 120, axis 121, spring clip 122, bifurcated elastic element 124, first flat curved element 126, second flat curved element 128, round member 130, round member 131, rotating member 132, first end 134, second end 136, exterior 138, longitudinal axis 140, cavity 142, wall 143, openings 144 and 145, first flange 146, second flange 148, bridge 150, first end 152, second end 154, cavity 156, flat exterior surface 158, longitudinal axis 159, flat exterior surfaces 158 and 160, first arm 162, flat surface 164, first hole 166, first end 168, second end 170, second hole 174, end 175, second arm 176, flat surface 178, first hole 180, first end 182, second end 184, second hole 188, end 189, first bolt 190, retaining member 192, retaining member 193, second bolt 194, retaining member 195, retaining member 196, cavity 197 and bridge 198, for sake of clarity a simplified handle 102, elongated portion 104, open end 106, bifurcated portion 108, first fork 110, inside portion 111, outside portion 112, second fork 114, inside portion 115, outside portion 116, first hole 118, axis 119, second hole 120, axis 121, spring clip 122, bifurcated elastic element 124, first flat curved element 126, second flat curved element 128, round member 130, round member 131, rotating member 132, first end 134, second end 136, exterior 138, longitudinal axis 140, cavity 142, wall 143, openings 144 and 145, first flange 146, second flange 148, bridge 150, first end 152, second end 154, cavity 156, flat exterior surface 158, longitudinal axis 159, flat exterior surfaces 158 and 160, first arm 162, flat surface 164, first hole 166, first end 168, second end 170, second hole 174, end 175, second arm 176, flat surface 178, first hole 180, first end 182, second end 184, second hole 188, end 189, first bolt 190, retaining member 192, retaining member 193, second bolt 194, retaining member 195, retaining member 196, cavity 197 and bridge 198 are described.

Figure 2:
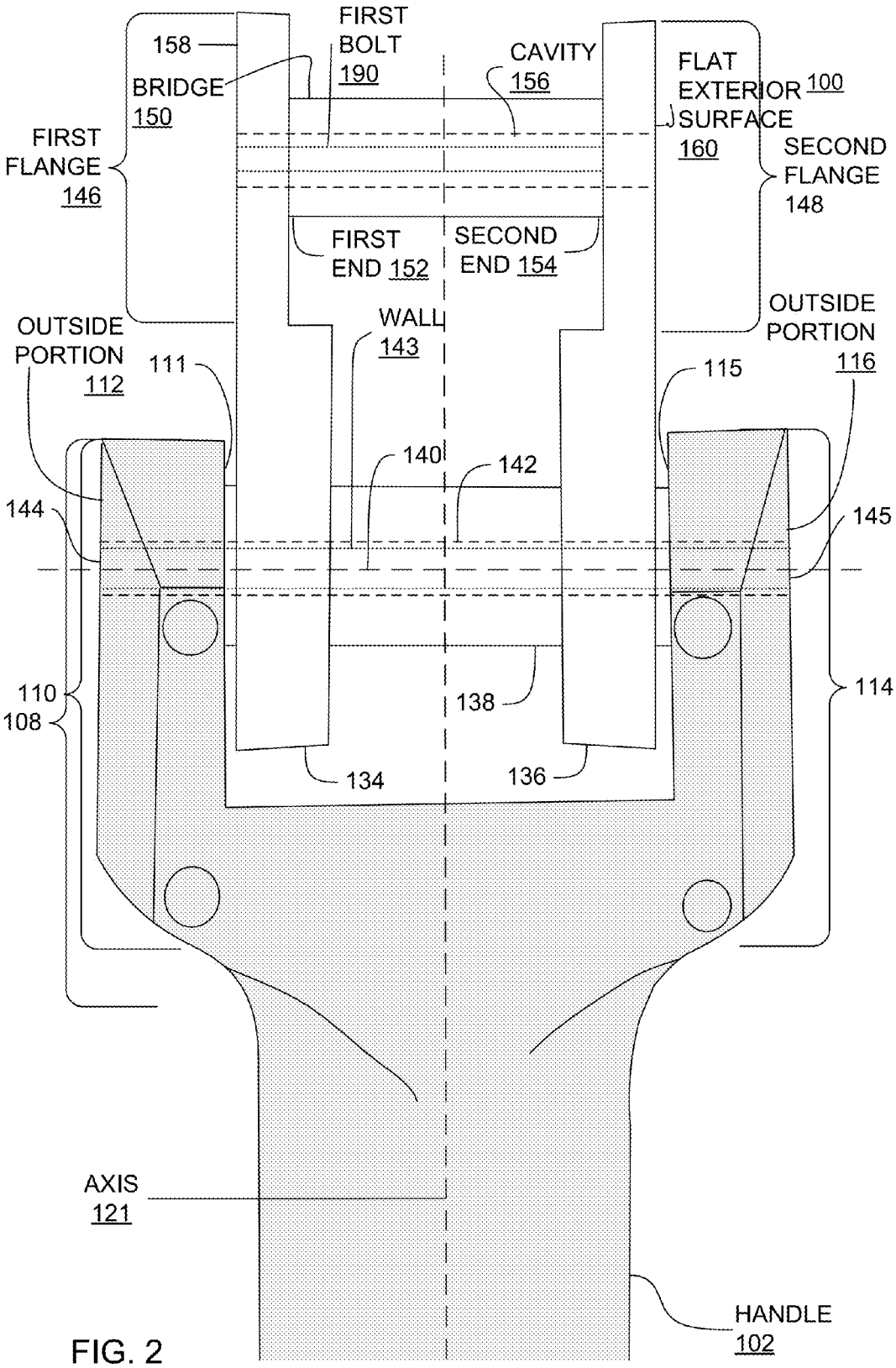
FIG. 2 is a top view cross section block diagram of apparatus showing detailed portions of the handle and the rotating member.

FIG. 2 is a top view cross section block diagram of apparatus 100 showing detailed portions of the handle and the rotating member.

The first fork 110 has an inside portion 111 and an outside portion 112. The bifurcated portion 108 also has a second fork 114. The second fork 114 has an inside portion 115 and an outside portion 116.

The inside portion 111 of the first fork 110 is directly opposing and opposite of the inside portion 115 of the second fork 114.

A rotating member 132 has a first end 134 and a second end 136. The first end 134 is rotatably mounted to the inside portion 111 of the first fork 110 of the bifurcated portion 104 of the handle 102. The second end 136 is rotatably mounted to the inside portion 115 of the second fork 116 of the bifurcated portion 104 of the handle 102. The exterior 138 of the rotating member 132 is substantially equidistant to a longitudinal axis 140 of the rotating member 132. The rotating member 132 includes a cavity 142 having a wall that is substantially equidistant to the longitudinal axis 140 of the rotating member 132. The cavity 142 having a wall 143 extends from the first end 134 of the rotating member 132 to the second end 136 of the rotating member 132. The cavity 142 forms openings 144 and 145 that extend from the first end 134 of the rotating member 132 to the second end 136 of the rotating member 132. The rotating member 132 has a first flange 146 and a second flange 148. The first flange 146 is connected by a bridge 150. The bridge 150 has a first end 152. The bridge 150 has a second end 154. The bridge 150 has a cavity 156. The cavity 156 has a longitudinal axis 159. The cavity 156 extends from the first end 152 of the bridge 150 to the second end 154 of the bridge 150. The cavity 156 also extends through each of the first flange 146 and the second flange 148. The first flange 146 and the second flange 148 each have flat exterior surfaces 158 and 160.

Figure 3:
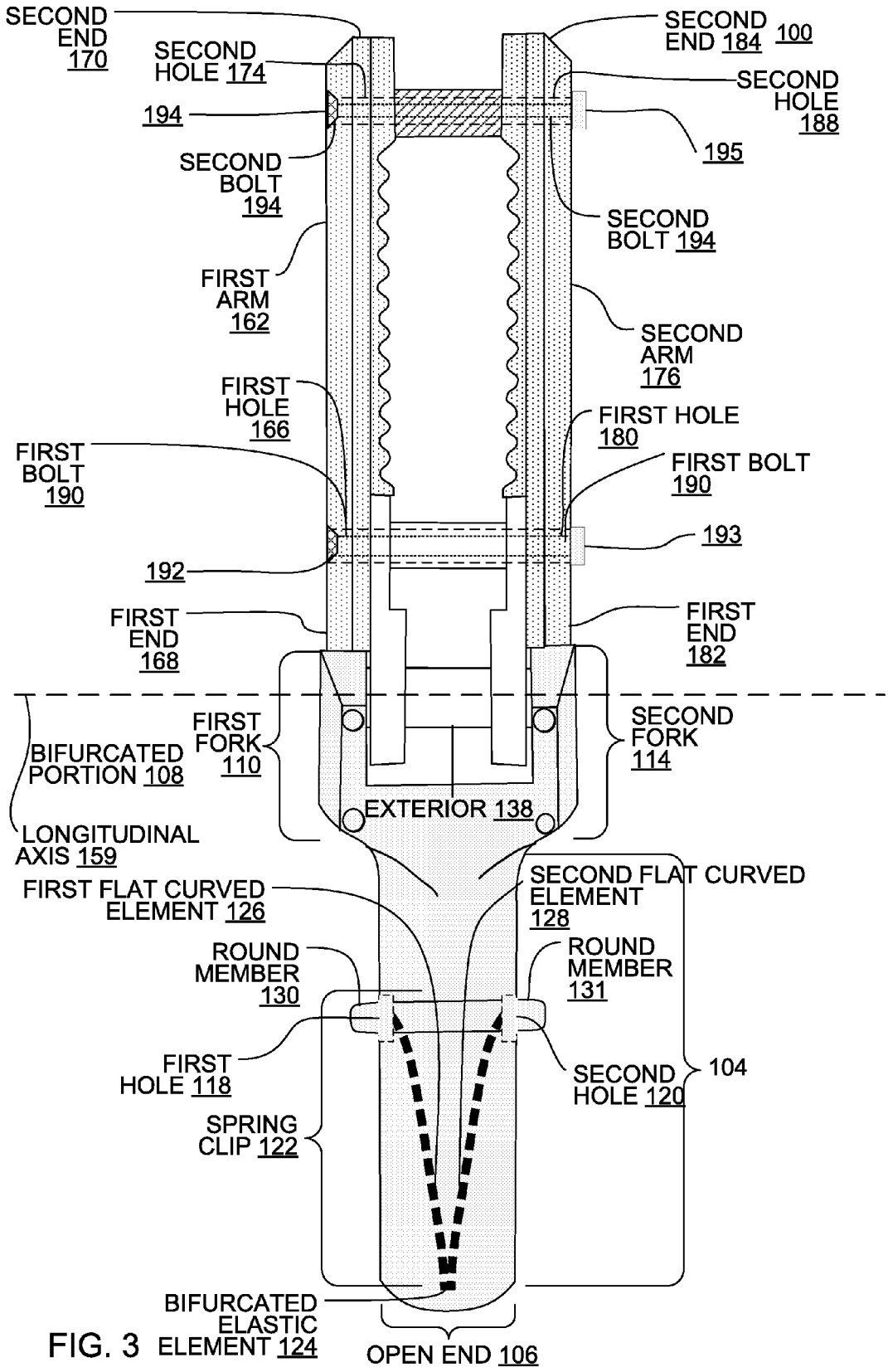
FIG. 3 is an assembled top view of a cross section block diagram of apparatus according to an implementation to hold a chlorine tablet.

FIG. 3 is an assembled top view of a cross section block diagram of apparatus 100 according to an implementation to hold a chlorine tablet.

Apparatus 100 includes a handle 102. The handle 102 includes a substantially round elongated portion 104. The substantially round elongated portion 104 is hollow. The substantially round elongated portion has an open end 106.

The handle 102 includes a bifurcated (forked) portion 108. The bifurcated portion 108 has a first fork 110. The bifurcated portion 108 also has a second fork 114. The hollow round elongated portion 104 has a first hole 118 that extends through the hollow round elongated portion 104 and a second hole 120 that extends through the hollow round elongated portion 104 directly opposite of the first hole 118 wherein an axis 119 extending between the first hole 118 and the second hole 120 are perpendicular to an axis 121 of the handle 102.

Some implementations of the hollow round elongated portion 104 include a spring clip 122 therein. The spring clip 122 is adapted to connect the handle 102 to a pool extension pole (not shown). The spring clip 122 includes a bifurcated elastic element 124 which encompasses a first flat curved element 126. The first flat curved element 126 converges at one end of the bifurcated elastic element 124 with a second flat curved element 128. The first flat curved element 126 has a round member 130. The round member 130 moves substantially perpendicular to the bifurcated plastic element 124. The round member 130 extends through the first hole 118 of the hollow round elongated portion 104 of the handle 102. The second flat curved element 128 has a round member 131. The round member 131 moves substantially perpendicular to the bifurcated plastic element 124. The round member 131 extends through the second hole 120 of the hollow round elongated portion 104 of the handle 102. When a pool extension pole is slid over the buttons 130 and 131, the buttons 130 and 131 will compress into the holes 118 and 120 of the handle 104 and when holes in the pool extension pole are positioned over the buttons 130 and 131, the buttons will be urged by compression force to pop into the holes of the pool extension pole, thereby immoveable engaging the apparatus 100 to the pool extension pole.

A first moveable arm 162 includes the first flange 146. The first hole 166 is positioned closer to a first end 168 of the first moveable arm 162 than a second end 170 of the first moveable arm 162. The first hole 166 has the same longitudinal axis as the longitudinal axis 159. The first moveable arm 162 has a second hole 174 positioned closer to the second end 170 of the first moveable arm 162 than the first end 168 of the first moveable arm 162. The first end 168 of the first moveable arm 162 is adjacent to the first fork 110.

A second moveable arm 176 has a first hole 180 that passes through the second moveable arm 176. The first hole 180 is positioned closer to a first end 182 of the second moveable arm 176 than a second end 184 of the second moveable arm 176. The first hole 180 has the same longitudinal axis as the longitudinal axis 159. The second moveable arm 176 has a second hole 188 that is positioned closer to the second end 184 of the second moveable arm 176 than the first end 182 of the second moveable arm 176. The first end 182 of the second moveable arm 176 is adjacent to the second fork 114.

Retaining member 192 and 193 are operable to urge the first moveable arm 162 and the second moveable arms 176 towards each other that provides adjustment of the distance between moveable arms 162 and 176 at the first end 168

Retaining member 195 and are operable to urge the first moveable arm 162 and the second moveable arm 176 towards each other that provides adjustment of the distance between moveable arms 162 and 176 at the second end 170.

Adjustment of the distance between the moveable arms 162 and 176 along the entire length of the moveable arms 162 and 176 allows symmetrically holding of a chlorine tablet between the moveable arms 162 and 176. Thus, a chlorine tablet can be placed and held with symmetrical force between the moveable arms 162 and 176 and retaining members 192, 193, 195 and 196.

Both of the moveable arms 162 and 176 have irregular surfaces on the opposing surfaces that are suitable for gripping an object, such as a pool chlorine tablet between the moveable arms 162 and 176 when the retaining members 192 and 193 are adjusted to provide pressure by the moveable arms 162 and 176 towards each other and when the retaining members 195 and 196 are adjusted to provide pressure by the moveable arms 162 and 176 towards each other.

Figure 4:
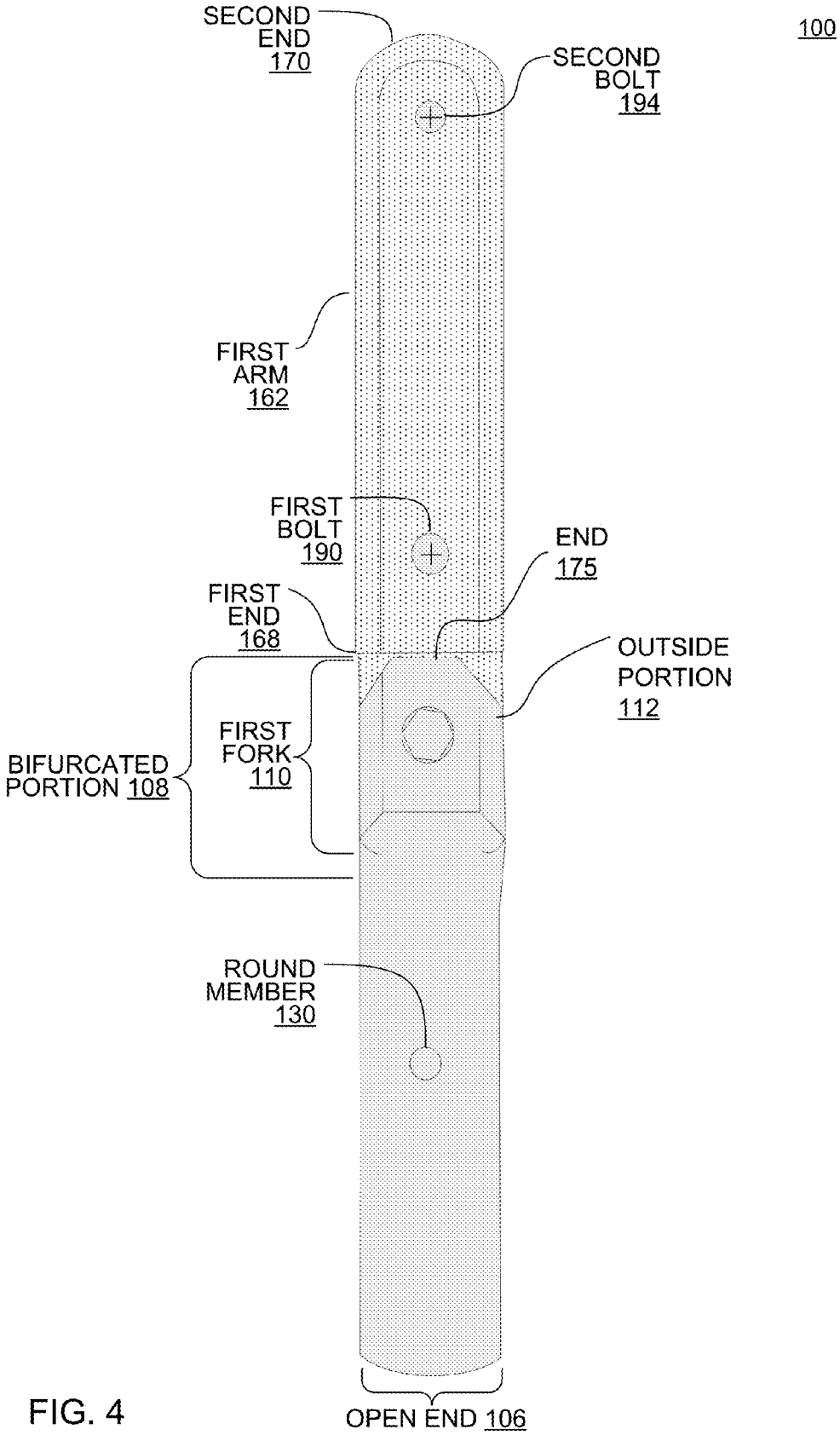
FIG. 4 is an assembled side view of a cross section block diagram of apparatus according to an implementation to hold a chlorine tablet.

FIG. 4 is an assembled side view of a cross section block diagram of apparatus 100 according to an implementation to hold a chlorine tablet.

Apparatus 100 includes an open end 106 and a bifurcated (forked) portion 108. The bifurcated portion 108 has a first fork 110. The first fork 110 has an outside portion 112.

Apparatus 100 includes a round member 130. Apparatus 100 includes a first moveable arm 162 having a first end 168 and a second end 170. The first end 168 of the first moveable arm 162 is adjacent to the end 175 of the first fork 110.

The first bolt 190 passes slideably through the first moveable arm 162. The first bolt 190 provides adjustment of the distance between moveable arms 162 and 176 (shown in FIG. 1) at the first end 168.

The second bolt 194 passes slideably through the first moveable arm 162. The second bolt 194 provides adjustment of the distance between moveable arms 162 and 176 (shown in FIG. 1) at the second end 170.

The first bolt 190 provides adjustment of the distance between moveable arms 162 and 176 (shown in FIG. 1) and in cooperation with the second bolt 194 that provides adjustment between moveable arms 162 and 176 (shown in FIG. 1), adjustment of the distance between the moveable arms 162 and 176 (shown in FIG. 1) along the entire length of the moveable arms 162 and 176 (shown in FIG. 1) allows symmetrically holding of a chlorine tablet between the moveable arms 162 and 176 (shown in FIG. 1). Thus, a chlorine tablet can be placed and held with symmetrical force between the moveable arms 162 and 176 (shown in FIG. 1) having bolts 190 and 194.

Figure 5:
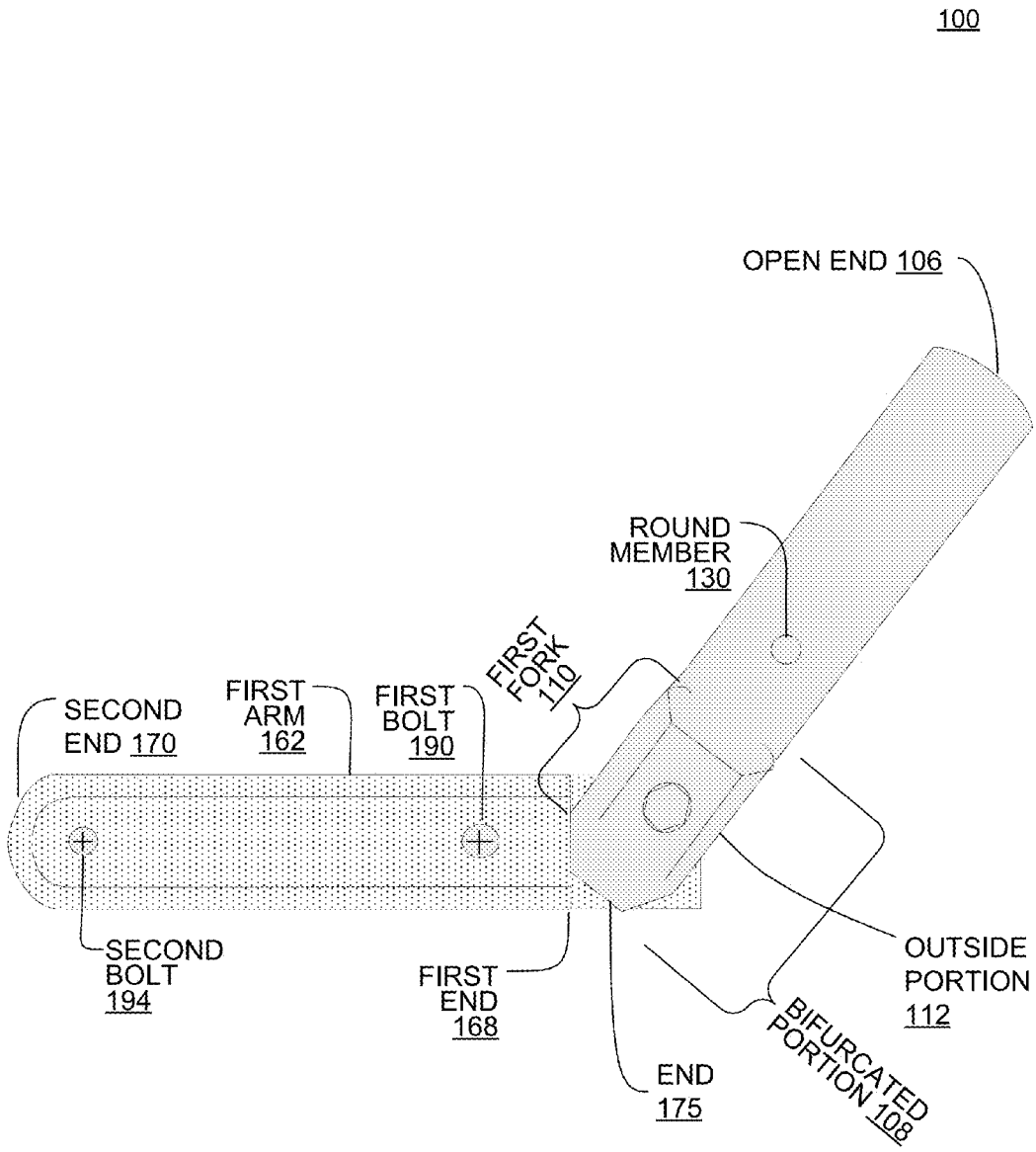
FIG. 5 is an assembled side view of a cross section block diagram of apparatus positioned for use with a chlorine tablet.

FIG. 5 is an assembled side view of a cross section block diagram of apparatus 100 positioned for use with a chlorine tablet.

Apparatus 100 includes an open end 106 and a bifurcated (forked) portion 108. The bifurcated portion 108 has a first fork 110. The first fork 110 has an outside portion 112.

Apparatus 100 includes a round member 130. Apparatus 100 includes a first moveable arm 162 having a first end 168 and a second end 170. The first end 168 of the first moveable arm 162 is adjacent to the end 175 of the first fork 110.

The first bolt 190 passes slideably through the first moveable arm 162. The first bolt 190 provides adjustment of the distance between moveable arms 162 and 176 (shown in FIG. 1) at the first end 168.

The second bolt 194 passes slideably through the first moveable arm 162. The second bolt 194 provides adjustment of the distance between moveable arms 162 and 176 (shown in FIG. 1) at the second end 170.

The first bolt 190 provides adjustment of the distance between moveable arms 162 and 176 (shown in FIG. 1) and in cooperation with the second bolt 194 that provides adjustment between moveable arms 162 and 176 (shown in FIG. 1), adjustment of the distance between the moveable arms 162 and 176 (shown in FIG. 1) along the entire length of the moveable arms 162 and 176 (shown in FIG. 1) allows symmetrically holding of a chlorine tablet between the moveable arms 162 and 176 (shown in FIG. 1). Thus, a chlorine tablet can be placed and held with symmetrical force between the moveable arms 162 and 176 (shown in FIG. 1) having bolts 190 and 194.

Figure 6:
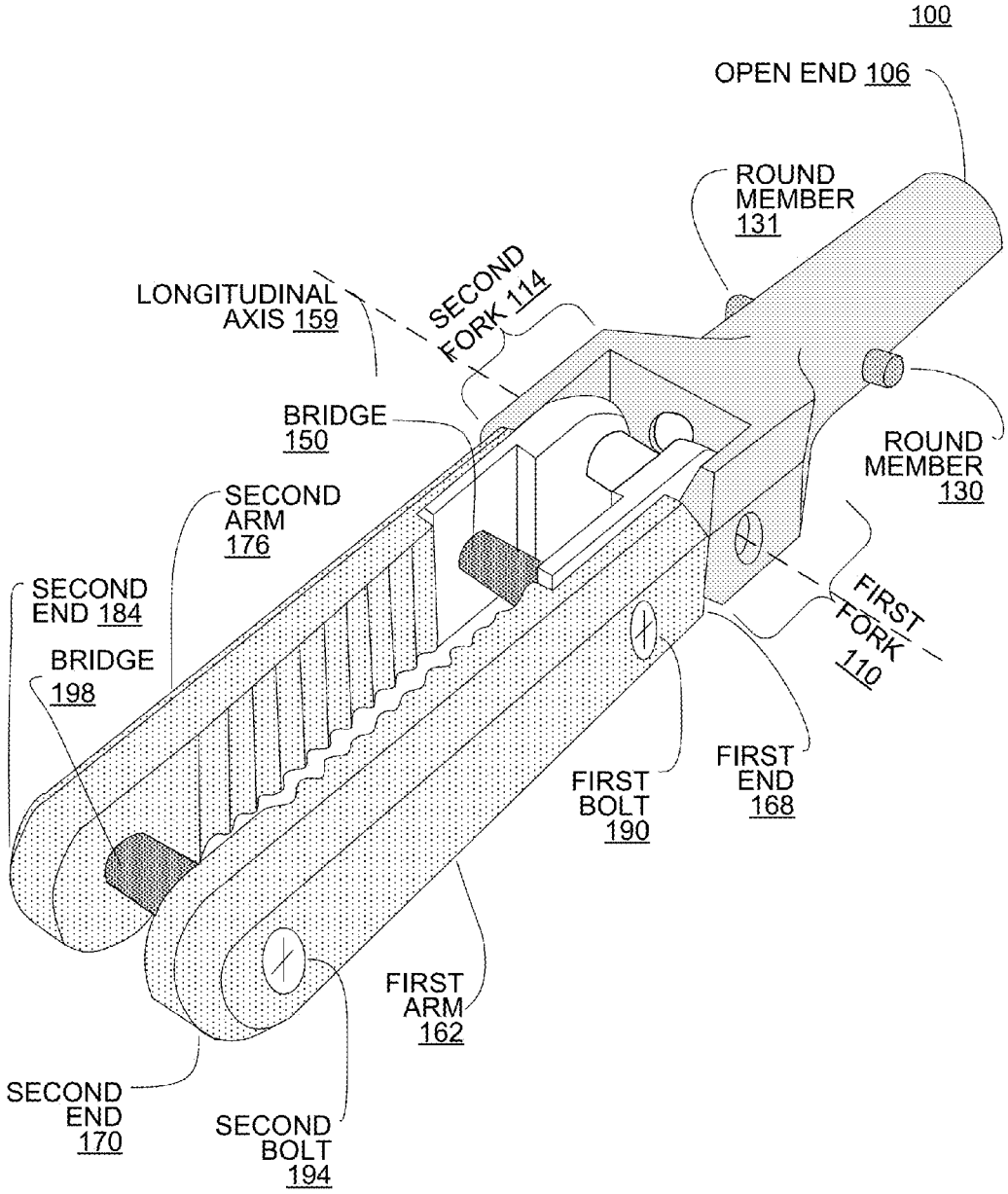
FIG. 6 is an isometric view block diagram of apparatus according to an implementation to hold a chlorine tablet.

FIG. 6 is an isometric view block diagram of apparatus 100 according to an implementation to hold a chlorine tablet.

Apparatus 100 includes a first fork 110 and a second fork 114.

Apparatus 100 includes a round member 130 and a round member 131.

Apparatus 100 includes a first moveable arm 162 having a first end 168 and a second end 170 of the first moveable arm 162. The first end 168 of the first moveable arm 162 is adjacent to the first fork 110.

Apparatus 100 includes a second moveable arm 176 having a second end 184.

The first bolt 190 passes slideably through the first moveable arm 162. The first bolt 190 provides adjustment of the distance between moveable arms 162 and 176 at the first end 168.

The second bolt 194 passes slideably through the first moveable arm 162 and the second moveable arm 176. The second bolt 194 provides adjustment of the distance between moveable arms 162 and 176 at the second end 170.

The first bolt 190 provides adjustment of the distance between moveable arms 162 and 176 and in cooperation with the second bolt 194 that provides adjustment between moveable arms 162 and 176, adjustment of the distance between the moveable arms 162 and 176 along the entire length of the moveable arms 162 and 176 allows symmetrically holding of a chlorine tablet between the moveable arms 162 and 176. Thus, a chlorine tablet can be placed and held with symmetrical force between the moveable arms 162 and 176 having bolts 190 and 194.

Both of the moveable arms 162 and 176 have irregular surfaces on the opposing surfaces that are suitable for gripping an object, such as a pool chlorine tablet between the moveable arms 162 and 176.

CONCLUSION

A pool chlorine tablet holder is described. Although specific implementations are illustrated and described herein, it will be appreciated by those of ordinary skill in the art that any arrangement which is calculated to achieve the same purpose may be substituted for the specific implementations shown. This application is intended to cover any adaptations or variations.

In particular, one of skill in the art will readily appreciate that the names of the methods and apparatus are not intended to limit implementations. Furthermore, additional methods and apparatus can be added to the components, functions can be rearranged among the components, and new components to correspond to future enhancements and physical devices used in implementations can be introduced without departing from the scope of implementations. One of skill in the art will readily recognize that implementations are applicable to future pool extension clips, different rotating members, and new moveable arms.

The terminology used in this application is meant to include all pool chlorine tablets and environments and alternate technologies which provide the same functionality as described herein.

The invention claimed is:

1. An apparatus comprising:

a handle comprising a substantially round elongated portion, the substantially round elongated portion being hollow with an open end, the handle further comprising a bifurcated portion, the bifurcated portion having a first fork having an inside portion and an outside portion, the bifurcated portion having a second fork, the second fork having an inside portion and an outside portion, the inside portion of the first fork being directly opposing and opposite to the inside portion of the second fork, the hollow round elongated portion having a first hole that extends through the hollow round elongated portion and a second hole that extends through the hollow round elongated portion directly opposite of the first hole wherein an axis extending between the first hole and the second hole are perpendicular to a longitudinal axis of the handle;

a rotating member having a first end and a second end, the first end being rotatable mounted to the inside portion of the first fork of the bifurcated portion of the handle and the second end being rotatably mounted to the inside portion of the second fork of the bifurcated portion of the handle, wherein an exterior of the rotating member is substantially equidistant to a longitudinal axis of the rotating member, wherein the rotating member includes a cavity that is substantially equidistant to the longitudinal axis of the rotating member, the cavity extending from the first end of the rotating member to the second end of the rotating member and forming an opening that extends from the first end of the rotating member to the second end of the rotating member, the rotating member having a first flange and a second flange, the first flange being connected by a bridge, the bridge having a first end and a second end, the bridge having a cavity, the cavity having a longitudinal axis, the cavity extending from the first end of the bridge to the second end of the bridge and through each of the first flange and the second flange, the first flange and the second flange each having flat exterior surfaces;

a first moveable arm having a flat surface facing the flat exterior surface of the first flange, having a first hole that passes through the first moveable arm, the first hole being positioned closer to a first end of the first moveable arm than a second end of the first moveable arm, the first hole having the same longitudinal axis as the longitudinal axis as the cavity of the bridge of the rotating member, the first moveable arm having a second hole positioned closer to the second end of the first moveable arm than the first end of the first moveable arm, the first end of the first moveable arm adjacent to the end of the first fork;

a second moveable arm having a flat surface facing the flat exterior surface of the second flange, having a first hole that passes through the second moveable arm, the first hole being positioned closer to a first end of the second moveable arm than a second end of the second moveable arm, the first hole having the same longitudinal axis as the longitudinal axis as the cavity of the bridge of the rotating member, the second moveable arm having a second hole positioned closer to the second end of the second moveable arm than the first end of the second moveable arm, the first end of the second moveable arm adjacent to the end of the second fork;

a first bolt passing slideably through the first hole of the first moveable arm, the cavity of the rotating member and the first hole of the second moveable arm, the first bolt having a retaining member at each end of the first bolt operable to urge the first moveable arm and the second moveable arms towards each other; and a second bolt passing slideably through the second hole of the first moveable arm, the cavity of the bridge and the second hole of the second moveable arm, the second bolt having a retaining member at each end of the second bolt operable to urge the first moveable arm and the second moveable arms towards each other.

2. The apparatus of claim 1, wherein the apparatus further comprises:

the hollow round elongated portion having a spring clip therein, the spring clip being adapted to connect the handle to a pool extension pole in which the spring clip includes:

a bifurcated elastic element having a first flat curved element that converges at one end of the two bifurcated elastic elements and a second flat curved element that converges with the first flat curved element, the first flat curved element having a round member that is substantially perpendicular to the bifurcated plastic element and extending through the first hole of the hollow round elongated portion of the handle and the second flat curved element having a round member that is substantially perpendicular to the bifurcated plastic element and extending through the second hole of the hollow round elongated portion of the handle.

3. An apparatus comprising:

a handle comprising a substantially round elongated portion, the substantially round elongated portion being hollow with an open end, the handle further comprising a bifurcated portion, the bifurcated portion having a first fork having an inside portion and an outside portion, the bifurcated portion having a second fork, the second fork having an inside portion and an outside portion, the inside portion of the first fork being directly opposing and opposite to the inside portion of the second fork, the hollow round elongated portion having a first hole that extends through the hollow round elongated portion and a second hole that extends through the hollow round elongated portion directly opposite of the first hole wherein an axis extending between the first hole and the second hole are perpendicular to an axis of the handle, the hollow round elongated portion having a spring clip therein, the spring clip being adapted to connect the handle to a pool extension pole in which the spring clip includes a bifurcated elastic element having a first flat curved element that converges at one end of the two bifurcated elastic elements and a second flat curved element that converges with the first flat curved element, the first flat curved element having a round member that is substantially perpendicular to the bifurcated plastic element and extending through the first hole of the hollow round elongated portion of the handle and the second flat curved element having a round member that is substantially perpendicular to the bifurcated plastic element and extending through the second hole of the hollow round elongated portion of the handle;

a rotating member having a first end and a second end, the first end being rotatable mounted to the inside portion of the first fork of the bifurcated portion of the handle and the second end being rotatably mounted to the inside portion of the second fork of the bifurcated portion of the handle, wherein an exterior of the rotating member is substantially equidistant to a longitudinal axis of the rotating member, wherein the rotating member includes a cavity that is substantially equidistant to the longitudinal axis of the rotating member, the cavity extending from the first end of the rotating member to the second end of the rotating member and forming an opening that extends from the first end of the rotating member to the second end of the rotating member, the rotating member having a first flange and a second flange, the first flange being connected by a bridge, the bridge having a first end and a second end, the bridge having a cavity, the cavity having a longitudinal axis, the cavity extending from the first end of the bridge to the second end of the bridge and through each of the first flange and the second flange, the first flange and the second flange each having flat exterior surfaces;

a first moveable arm having a flat surface facing the flat exterior surface of the first flange, having a first hole that passes through the first moveable arm, the first hole being positioned closer to a first end of the first moveable arm than a second end of the first moveable arm, the first hole having the same longitudinal axis as the longitudinal axis as the cavity of the bridge of the rotating member, the first moveable arm having a second hole positioned closer to the second end of the first moveable arm than the first end of the first moveable arm, the first end of the first moveable arm adjacent to the end of the first fork;

a second moveable arm having a flat surface facing the flat exterior surface of the second flange, having a first hole that passes through the second moveable arm, the first hole being positioned closer to a first end of the second moveable arm than a second end of the second moveable arm, the first hole having the same longitudinal axis as the longitudinal axis as the cavity of the bridge of the rotating member, the second moveable arm having a second hole positioned closer to the second end of the second moveable arm than the first end of the second moveable arm, the first end of the second moveable arm adjacent to the end of the second fork;

a first bolt passing slideably through the first hole of the first moveable arm, the cavity of the rotating member and the first hole of the second moveable arm, the first bolt having a retaining member at each end of the first bolt operable to urge the first moveable arm and the second moveable arms towards each other; and a second bolt passing slideably through the second hole of the first moveable arm, the cavity of the bridge and the second hole of the second moveable arm, the second bolt having a retaining member at each end of the second bolt operable to urge the first moveable arm and the second moveable arms towards each other.

* * * * *